US005834990A

United States Patent [19]

Hahn et al.

[11] Patent Number: 5,834,990

[45] Date of Patent: Nov. 10, 1998

[54] HIGH-FREQUENCY SWITCHING DISTRIBUTOR

[75] Inventors: Claus Hahn, Remshalden; Klaus Koehne, Esslingen, both of Germany

[73] Assignee: Ge-tronic Geislinger Electronic GmbH Nachrichtentechnik, Germany

[21] Appl. No.: 846,249

[22] Filed: Apr. 30, 1997

Related U.S. Application Data

[63] Continuation of PCT/EP96/03404 Aug. 2, 1996.

[30] Foreign Application Priority Data

Aug. 30, 1995 [DE] Germany ..... 195 31 951.6

[51] Int. Cl.[6] ..... H01P 1/10; H01P 1/15

[52] U.S. Cl. ..... 333/101; 333/104

[58] Field of Search ..... 333/101, 103–105; 307/113, 115

[56] References Cited

U.S. PATENT DOCUMENTS

| | | | |
|---|---|---|---|
| 3,321,717 | 5/1967 | Harper | 333/103 |
| 3,813,497 | 5/1974 | Wachs et al. | 340/825.03 |
| 4,525,689 | 6/1985 | Wagner et al. | 333/104 |
| 4,779,065 | 10/1988 | Katz et al. | 333/101 |
| 5,053,731 | 10/1991 | Algiere et al. | 333/101 |
| 5,446,424 | 8/1995 | Pierro | 333/104 |

FOREIGN PATENT DOCUMENTS

| | | |
|---|---|---|
| 2339757 | 2/1974 | Germany . |

*Primary Examiner*—Paul Gensler

*Attorney, Agent, or Firm*—Barry R. Lipsitz; Ralph F. Hoppin

[57] ABSTRACT

A high-frequency switching distributor has a simple construction that is as free of intersections as possible. The distributor includes two or more distributor circuits arranged in two planes on top of one another in a circuit board. Each distributor circuit has an input terminal, and a line connecting the input terminal to a branching circuit. The branching circuit branches into N branch lines, where each branch line has a switch for switchably connecting the branch line to one of N associated output terminals. The output terminals of the two or more distributor circuits are connected to one another.

24 Claims, 6 Drawing Sheets

HIGH-FREQUENCY SWITCHING DISTRIBUTOR

This application is a continuation of International PCT application No. PCT/EP96/03404 filed on Aug. 2, 1996.

BACKGROUND OF THE INVENTION

The invention relates to a high-frequency switching distributor for switching over between a plurality of inputs and a plurality of outputs, in particular a plurality of inputs connectible to antenna converters (LNBS) and a plurality of outputs connectible to receivers.

Such high-frequency switching distributors are known from the prior art and are widely used in association with parabolic antennae for satellite reception in the consumer electronics field. These switching distributors frequently give rise to intersections on the circuit boards which are costly to implement as in the HF range all the conductor paths on the circuit boards must always extend at a defined distance from an earth surface in order to obtain a standard characteristic impedance.

Such intersections are costly to implement and always have the disadvantage that in the intersection zone bridging is unavoidable. Moreover, the known high-frequency distributors have the disadvantage that their construction is very bulky.

Finally, the known switching distributors have the disadvantage that they are very expensive on account of the production outlay.

Therefore the object of the invention is to make available a switching distributor which to the greatest possible extent is of simple construction, free of intersections and compact.

SUMMARY OF THE INVENTION

This object is fulfilled, in the case of a high-frequency switching distributor of the type described in the introduction, in accordance with the invention in that the switching distributor comprises at least two distributor circuits which are arranged on at least one circuit board, that each distributor circuit comprises, as conductor paths, lines which extend at a defined distance from an earth and which are arranged on a dielectric layer, that each of the two distributor circuits is in each case arranged in one of at least two planes extending one above another, that each of the distributor circuits has a first terminal, a line which is connected to the first terminal, a branching circuit branching into N branch lines and in each case having a switch arranged in each of the N branch lines, and N second terminals each of which is connected to one of the N branch lines, and that in each case one of the N second terminals of a distributor circuit is connected to another of the N second terminals of the other distributor circuit.

The design according to the invention has the great advantage that, by virtue of the arrangement of one distributor circuit, for example a 1-in-N or N-in-1 distributor circuit, in one single plane, this distributor circuit can be constructed without intersections, and that the arrangement of the different distributor circuits in different planes extending one above another offers the possibility of providing the switching distributor according to the invention with as compact as possible a construction.

Preferably, the lines on the circuit board which extend at a defined distance from the earth are either microstrip lines or coplanar lines.

The switching distributor according to the invention can be constructed in a particularly compact manner if the planes in which the individual distributor circuits are arranged extend in parallel to one another.

Here it is provided, for example, that one distributor circuit with its corresponding two-layer circuit board in each case be arranged in one plane.

A particularly compact embodiment of the design according to the invention provides that the two distributor circuits are arranged on opposite sides of a common earth layer on a three-layer circuit board, so that the one distributor circuit is disposed on the upper side of the three-layer circuit board and the other distributor circuit is disposed on the lower side thereof, and the earth layer constitutes a good HF screen with the result that mutual influencing of the distributor circuits is substantially avoided.

This design concept can be developed, in accordance with the invention, in the case of more than two distributor circuits in that a plurality of three-layer circuit boards are provided, on each of which the distributor circuits are in each case arranged on the upper side and the lower side.

No details of the branching circuit have been given in association with the design according to the invention. This branching circuit could for example be designed as a Wilkinson divider, a directional coupler or a ferrite distributor or -collector. However, a particularly advantageous exemplary embodiment provides that the branching circuit has the form of a resistance branching circuit, as such a resistance branching circuit offers the possibility of providing the branching circuit itself with as compact as possible a construction.

No details of the switches in the distributor circuits have been given in association with the explanation of the exemplary embodiments. Thus it is preferably provided that the switches have the form of semiconductor switches.

Preferably, such semiconductor switches can be controlled via voltages or signals applied at the output end of the switching distributor through the receivers in a manner already known from the prior art.

In order to achieve the best possible screening of the different distributor circuits one from another, preferably it is provided that the earth layer, with the exception of the regions of the first and second terminals, have no HF inlets.

The connections between the second terminals of different distributor circuits can be formed in any desired manner. Thus for example it would be conceivable to connect each of the second terminals via a corresponding cable to an input or output of the switching distributor according to the invention and thus to provide, via the input or output itself, a connection between one of the second terminals of the one distributor circuit and one of the N terminals of the other distributor circuits.

However, a particularly advantageous exemplary embodiment provides that in each case one of the N second terminals of the one distributor circuit be connected via a plane branching line to in each case one of the N second terminals of the other distributor circuit or the other distributor circuits to form a common terminal. That is to say that, via this plane branching line, the shortest possible connection is to be established between the individual second terminals.

Here it is particularly expedient for the plane branching lines to extend transversely to the earth layer.

The plane branching lines can be arranged in a particularly advantageous manner if they extend in parallel to one another so that the bridging between the individual plane branching lines is as small as possible.

A particularly advantageous embodiment provides that the plane branching lines extend at right angles to the earth layer.

A particularly expedient embodiment provides that an earth screen is provided between plane branching lines adjacent to one another, which earth screen is formed in the simplest case by a line running between the plane branching lines and preferably extending in parallel thereto.

The plane branching lines can themselves be formed by microstrip lines arranged on a circuit board. In order to obtain a construction which is as simple and compact as possible, it has provided advantageous to form the plane branching lines as lines which are free of the circuit board. In the simplest case the plane branching lines have the form of HF through-contacts or pin connections.

In particular, the plane branching lines are formed by HF through-contacts in the case of distributor circuits arranged on two sides of a circuit board and are formed by pin connections in the case of two circuit boards arranged at a distance from one another.

However, in order to obtain plane branching lines which can be constructed as simply as possible, it is advantageous for the plane branching lines to be arranged in one branching plane as this permits a particularly simple connection between the plane branching lines and the respective second terminals of the distributor circuit.

In order, here again, to obtain a construction of the switching distributor according to the invention which is particularly simple and advantageous in terms of bridging, advantageously it is provided that the plane branching lines extend without intersections in the branching plane.

Whereas no details of the position of the second terminals in the various planes have been given in association with the previous explanation of the individual exemplary embodiments, advantageously it is provided that in the case of a three-layer circuit board the N second terminals of the two distributor circuits are disposed opposite one another.

Preferably here the N second terminals are in each case arranged mirror-symmetrically to the earth layer.

However it is particularly advantageous if the N second terminals of the two distributor circuits are arranged in a second row of terminals of the circuit board, where preferably the second row of terminals is arranged in the branching plane.

To enable the circuit board also to be used in a position rotated by 180° about an inversion axis, the N second terminals are arranged inversion-symmetrically relative to the inversion axis.

Here preferably in the second row of terminals the N second terminals are arranged at substantially constant distances from one another.

It is also advantageous if the first terminals of the two distributor circuits, when projected at right angles to one of the planes, are arranged in a first row of terminals and thus, when projected onto one of the planes, do not coincide with one another. Preferably the first terminals in the first row of terminals are likewise arranged at substantially constant distances from one another.

An exemplary embodiment which has proved particularly expedient is that wherein the first and second rows of terminals are arranged in mutually opposed regions of the circuit board as in this case—as will be described in the following—one circuit board can be used inverted relative to the other circuit board in a simple manner.

Preferably it is provided that the first and second rows of terminals extend in parallel to side edges of the circuit board disposed opposite one another, and in particular close to the latter.

In order to be able to connect the different planes in the region of the N second terminals in a simple manner, advantageously it is provided that the N second terminals in the second row of terminals possess the same distance from one another.

Furthermore it is advantageous, in particular in order to be able to use the circuit boards in a position relative to one another rotated by 180° about an inversion axis, that in the case of one distributor circuit the first terminal possesses a first distance from a mirror plane and in the case of another distributor circuit the first terminal possesses a second distance from a mirror plane extending through the inversion axis, so that both in the case of a 180°-rotated arrangement of the circuit board with the first distributor circuit, and in the case of a 180°-rotated arrangement of the circuit board with the second distributor circuit, all the first terminals of all the distributor circuits, when the latter are projected onto a plane, are spaced at a distance from one another.

Here it is particularly advantageous if all the circuit boards are provided with openings for pin connections extending at right angles to the planes and leading to the individual first terminals.

Preferably here it is provided that each circuit board comprises a first row of terminals with openings arranged on both sides of the mirror plane at a first and a second interval, which openings are preferably arranged in a first row of terminals.

Here it is particularly expedient for the openings to possess an equal distance from one another.

In order to achieve as compact as possible a construction in the case of more than two planes, it is particularly advantageous for at least two circuit boards with in each case two distributor circuits to be arranged one above another in the form of a stack.

Here expediently the first row of terminals and the second row of terminals are arranged such that the terminals are disposed one above another in the stack. It is particularly expedient if the N second terminals of the second rows of terminals are connected to one another via plane branching lines extending transversely to the circuit boards.

A particularly expedient embodiment in the case of the use of two circuit boards provides that the two circuit boards are of identical construction, where a particularly expedient contacting of the circuit boards can be obtained if one of the circuit boards in the stack is arranged relative to the other rotated by 180° about the inversion axis. In this way a second circuit board design can be avoided and the one circuit board can be produced with double the number of components and thus in a more economical manner.

No details have been given concerning the type of connection of the first and second terminals to the inputs and outputs of the switching distributor according to the invention in association with the previous description of the individual exemplary embodiments. Thus an advantageous embodiment provides that each of the first terminals is in each case connected to one input of the switching distributor and each of the N second terminals of each distributor circuit is connected to one of the outputs. In this case the individual distributor circuits are designed as 1-in-N distributors.

Alternatively, it is also conceivable for each of the first terminals in each case to be connected to one output and for each of the N second terminals of a distributor circuit in each case to be connected to one input. In this case the individual distributor circuits are N-in-1 distributors.

In order to minimize the number of the distributor circuits, on the basis of the two possibilities referred to in the foregoing, advantageously it is provided that the number of the distributor circuits corresponds to the number of the outputs when this number is smaller than the number of the inputs, or corresponds to the number of the inputs when this number is smaller than the number of the outputs.

Further features and advantages of the design according to the invention form the subject of the following description, and illustration in the drawing, of individual exemplary embodiments.

DETAILED DESCRIPTION OF THE INVENTION

Figure 1:
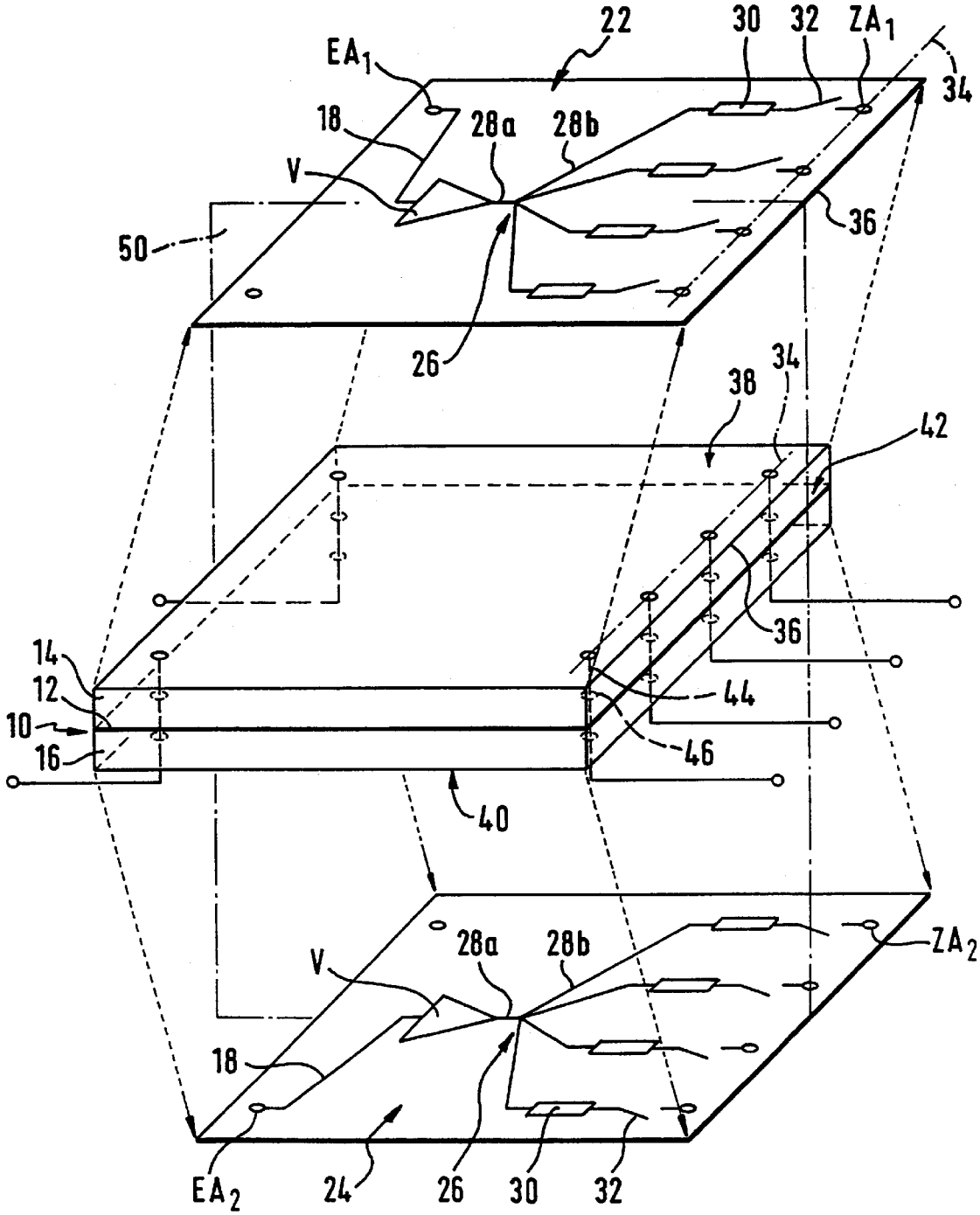
FIG. 1 schematically illustrates a first exemplary embodiment of a switching distributor according to the invention with no housing and with distributor circuits shown raised from the circuit board.

A first exemplary embodiment of a high-frequency switching distributor according to the invention, illustrated in FIG. 1, comprises a three-layer circuit board bearing the overall reference 10, which has an earth layer 12 on the upper side of which a dielectric layer 14 is arranged and on the lower side of which a dielectric layer 16 is arranged. On these dielectric layers 14 and 16 extend conductor paths 18, 28*a*, 28*b*, in the form of microstrip lines, of distributor circuits bearing the overall reference 22 and 24.

The conductor paths 18, 28*a*, 28*b* in the form of microstrip lines possess a uniform characteristic impedance due to the dielectric 14, 16 disposed between the common earth layer 12 for high frequency.

Each of the distributor circuits 22 and 24, which in FIG. 1 have been shown raised from the circuit board 10 in order to clarify the individual elements, comprises a first terminal EA, from which a conductor path 18 leads to an amplifier V, a branching circuit 26 which possesses a conductor path 28*a* which is connected to the amplifier V and which branches into N conductor paths 28*b* with resistors 30 arranged therein, so that the branching circuit 26 has the form of a resistance branching circuit.

Each of the N conductor paths 28*b* is connectible via a switch 32 to in each case one of N second terminals ZA, where the switches 32 are preferably formed by semiconductor switches.

The total of N terminals ZA are arranged in the form of a second row of terminals 34 close to a side edge 36 of the circuit board 10.

In accordance with the invention, all N second terminals $ZA_1$ of the upper distributor circuit 22 arranged in a plane 38 and all N second terminals $ZA_2$ of the lower distributor circuit 24 arranged in a plane 40 are disposed in pairs mirror-symmetrically to a plane 42 in which the earth layer 12 extends, so that each of the N second terminals $ZA_1$ of the upper distributor circuit 22 is connectable to the corresponding terminal of the N second terminals $ZA_2$ of the lower distributor circuit 24 in each case via a connection line 44 extending at right angles to the plane 42, where the connection line 44 extends in contact-free manner through an opening 46 in the earth layer 12.

The first terminal $EA_1$ of the upper distributor circuit 22 and the first terminal $EA_2$ of the lower distributor circuit 24 are arranged on opposite sides of, and at the same distance from, a mirror plane 50 which extends at right angles to the planes 38 to 42 and at right angles to the second row of terminals 34, preferably approximately centrally in relation to the circuit board 10, so that the first terminals $EA_1$ and $EA_2$ lie on different sides of the mirror plane 50.

Figure 2:
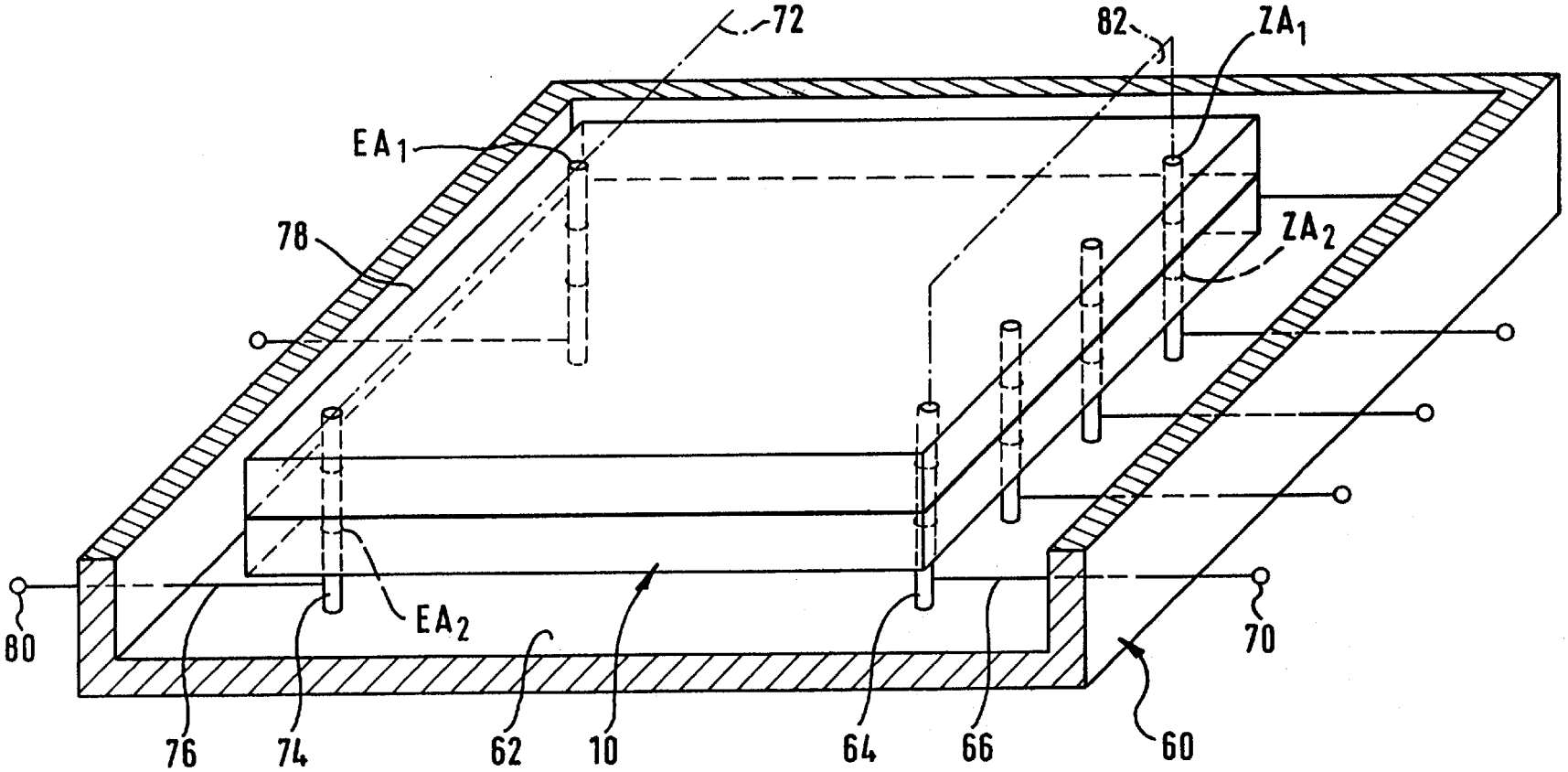
FIG. 2 schematically illustrates the switching distributor according to the invention with a housing shown in cross-section and broken away down to the base area.

As shown in FIG. 2, a housing 60 of the high-frequency switching distributor according to the invention is provided with a base 62 on which, in the region of the N second terminals $ZA_1$ and $ZA_2$, there is arranged a row of pins 64 which project above the base 62 and can be passed through the circuit board 10 and conductively connected to the second terminals $ZA_1$ and $ZA_2$, where the pins 64 simultaneously form the connection lines 44. In the first exemplary embodiment each of the pins 64 is connected to an output line 66 which leads to the corresponding output 70, so that the high-frequency switching distributor has a total of N outputs 70 which are formed for example by conventional high-frequency connection plugs or sockets.

Also arranged on the base 62 in the region of the first terminals $EA_1$ and $EA_2$ are upwardly projecting pins 74 which likewise can be passed through the circuit board 10, where the first terminals $EA_1$ and $EA_2$ preferably likewise form a first row of terminals 72 arranged along and close to a side edge 78 opposite the side edge 36 of the circuit board 10.

In the first exemplary embodiment the pins 74 are themselves connected by input lines 76 to inputs 80 of the high-frequency switching distributor.

In the design according to the invention the pins 64 and 74 preferably serve not only to contact the circuit board 10 but at the same time to fix the latter.

The first exemplary embodiment with the upper distributor circuit 22 and the lower distributor circuit 24 is referred to in the conventional manner as a two-in-four switching distributor, i.e. two inputs 80 are distributed between N=4 outputs 70, where the connection lines 44 between the N second terminals $ZA_1$ and $ZA_2$ serve as collector elements in relation to the distributor circuits 22 and 24 and constitute a plane branching located in a branching plane 82 extending at right angles to the planes 38 to 42 and through the second row of terminals 34.

Figure 3:
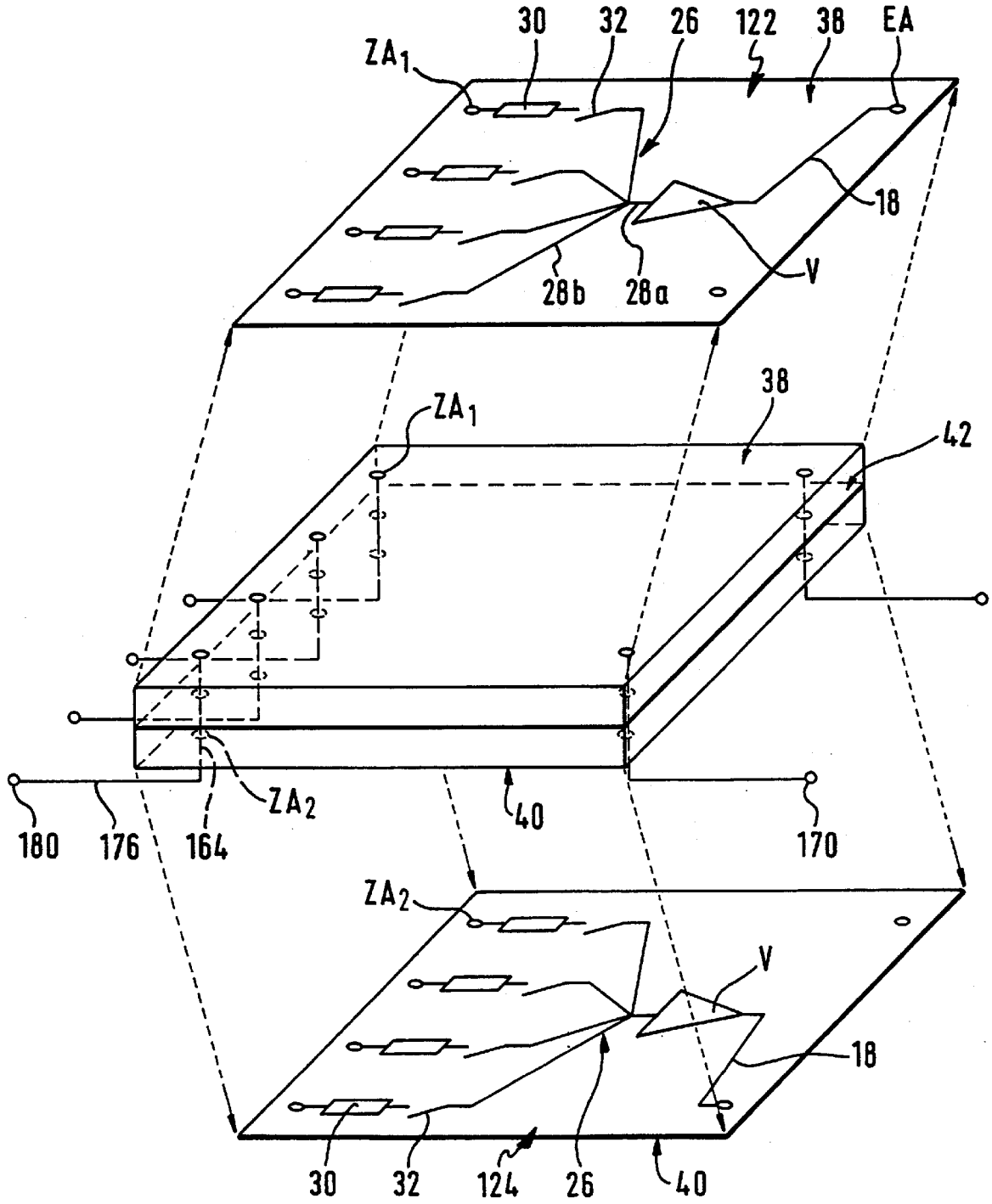
FIG. 3 is a schematic illustration similar to FIG. 1 of a second exemplary embodiment.

A second exemplary embodiment of a high-frequency switching distributor constructed in accordance with the invention, illustrated in FIG. 3, represents, in contrast to the first exemplary embodiment, a four-in-two switching distributor, i.e. N=4 inputs 180 are distributed between two outputs 170.

In this case the inputs 180 are connected via input lines 176 to pins 164 which form the plane branching lines 44 and in each case connect the N=4 second terminals $ZA_1$ and $ZA_2$ to one another in pairs.

In each of the planes 38 and 40 there is again arranged a distributor circuit 122 and 124 which likewise comprises the switches 32 which are connected to the second terminals ZA, then followed by the branching circuit 26 with the N conductor paths 28*b* and with the conductor path 28*a*, and then followed by the amplifier V which itself is connected to the first terminal EA via the conductor path 18.

In contrast to the first exemplary embodiment, in the case of the second exemplary embodiment in the distributor circuits 122, 124 the resistors 30 are arranged between the second terminals ZA and the switches 32.

In contrast to the distributor circuits 22 and 24 in the case of which the amplifier V amplifies the signal applied to the respective first terminal EA, in the case of the distributor circuits 122 and 124 the amplifier V amplifies the signal incoming via the conductor path 28*a* and emits the amplified signal to the conductor path 18 and thus to the respective first terminal EA.

In other respects the second exemplary embodiment corresponds to the first exemplary embodiment and therefore reference is made to the description thereof in its entirety.

Figure 4:
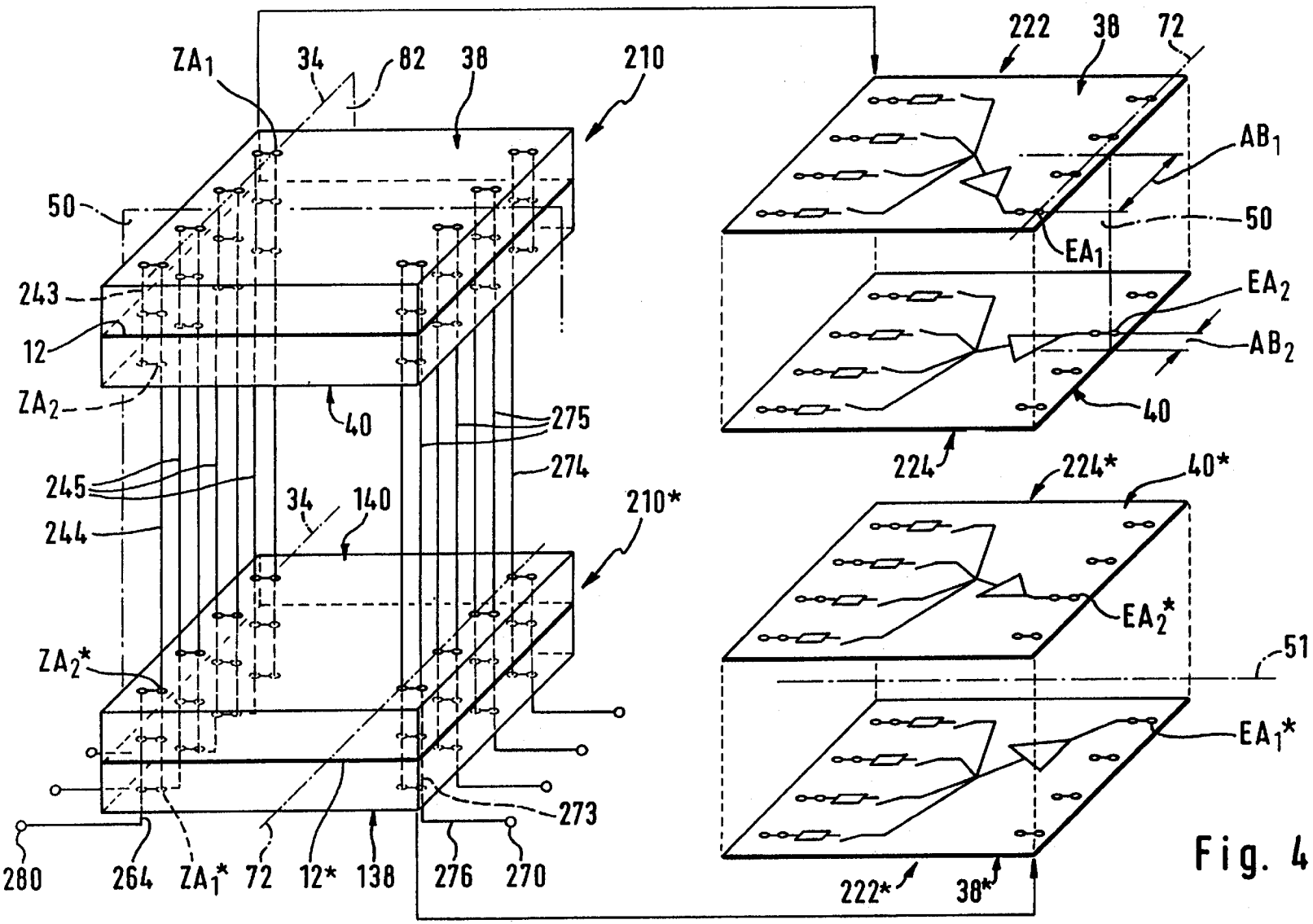
FIG. 4 schematically illustrates a third exemplary embodiment with distributor circuits again shown raised from the circuit boards but in the correct spatial relationship to one another.

In the case of a third exemplary embodiment illustrated in FIG. 4, of a switching distributor according to the invention, a four-in-four switching distributor has been shown. This four-in-four switching distributor comprises, in each of four planes 38, 40, 138, 140, a respective distributor circuit 222 or 224. The distributor circuit 22 is fundamentally of identical design to the distributor circuit 122, while the distributor circuit 224 differs from the distributor circuit 222 in that the first terminal $EA_2$ is spaced from the mirror plane 50 by a distance AB2 which amounts to one third of the distance AB1 by which the first terminal $EA_1$ of the distributor circuit 222 is spaced from the mirror plane 50. Furthermore, the terminal $EA_2$ is preferably arranged on that side of the mirror plane 50 opposite the first terminal $EA_1$.

This has the advantage that in the case of the third exemplary embodiment, the four-in-four switching distributor can be produced from two identical circuit boards 210 with distributor circuits 222, 224, 222*, 224* identical to one another, where the second circuit board 210* is arranged, in relation to the first circuit board 210, rotated by 180° about an axis of symmetry 51 extending in the mirror plane 50, so that the first terminals $EA_1$* and $EA_2$* are mirror-inverted relative to the mirror plane 50 and thus all the first terminals $EA_1$* and $EA_2$* occupy different positions in the first row of terminals 72. The possibility thus exists of contacting in each case one of the first terminals EAR, $EA_2$, $EA_1$* or $EA_2$* by connection lines 274 extending at right angles to the earth layers 12 and 12*, for example in the form of connection pins, so that in a simple manner all of the first terminals of all the distributor circuits 222 and 224, 222* and 224* can be contacted by the connection lines 274 extending at right angles to the earth layers 12 and 12*. As the second terminals $ZA_1$, $ZA_2$ and $ZA_1$*, $ZA_2$* in the second rows of terminals 34 of each circuit board 210, 210* also extend symmetrically to the mirror plane 50 and in particular at constant intervals from one another and mirror-symmetrically in relation to the respective earth layer 12 or 12*, and the circuit boards 210 and 210* are identical, the plane branching lines 244 can also be formed in a simple manner as lines running at right angles to the planes 38, 40 and 38*, 40* and extending in the branching plane 82, preferably pin lines, so that in this case the signals applied to the inputs 280 are distributed between all the distributor circuits 222, 224, 222* and 224* via these plane branching lines 244.

In the third exemplary embodiment described in FIG. 4, the plane branching lines 244 are pin connections which are not identical to the pins 264 of the housing which project from the base 62 and which in the case of the exemplary embodiment according to FIG. 4 contact only one of the two circuit boards 210*.

In the same way, the outputs 270 are also directly connected to pins 273 which project from the base 62 and which likewise contact only one of the two circuit boards 210 or 210*, where the pins 273 are in direct contact with the lines 274 via connecting conductor paths 276.

Preferably the second terminals $ZA_1$, $ZA_2$ and $ZA_1$*, $ZA_2$* are additionally connected to one another by through-contacts 243 which extend through the respective circuit boards 210 and 210*.

In order also to screen the individual plane branching lines 244 and the connection lines 274 from one another, between two adjacent lines there are preferably also arranged earth lines 245 and 275 which, in particular with the respective lines leading to the first and second terminals EA and ZA, form parallel HF lines with the desired characteristic impedance and in each case connect the earth layers 12 and 12* to one another.

With regard to the construction of the distributor circuits 222 and 224, reference is made to the descriptions of the second exemplary embodiment and the first exemplary embodiment in their entirety.

Figure 5:
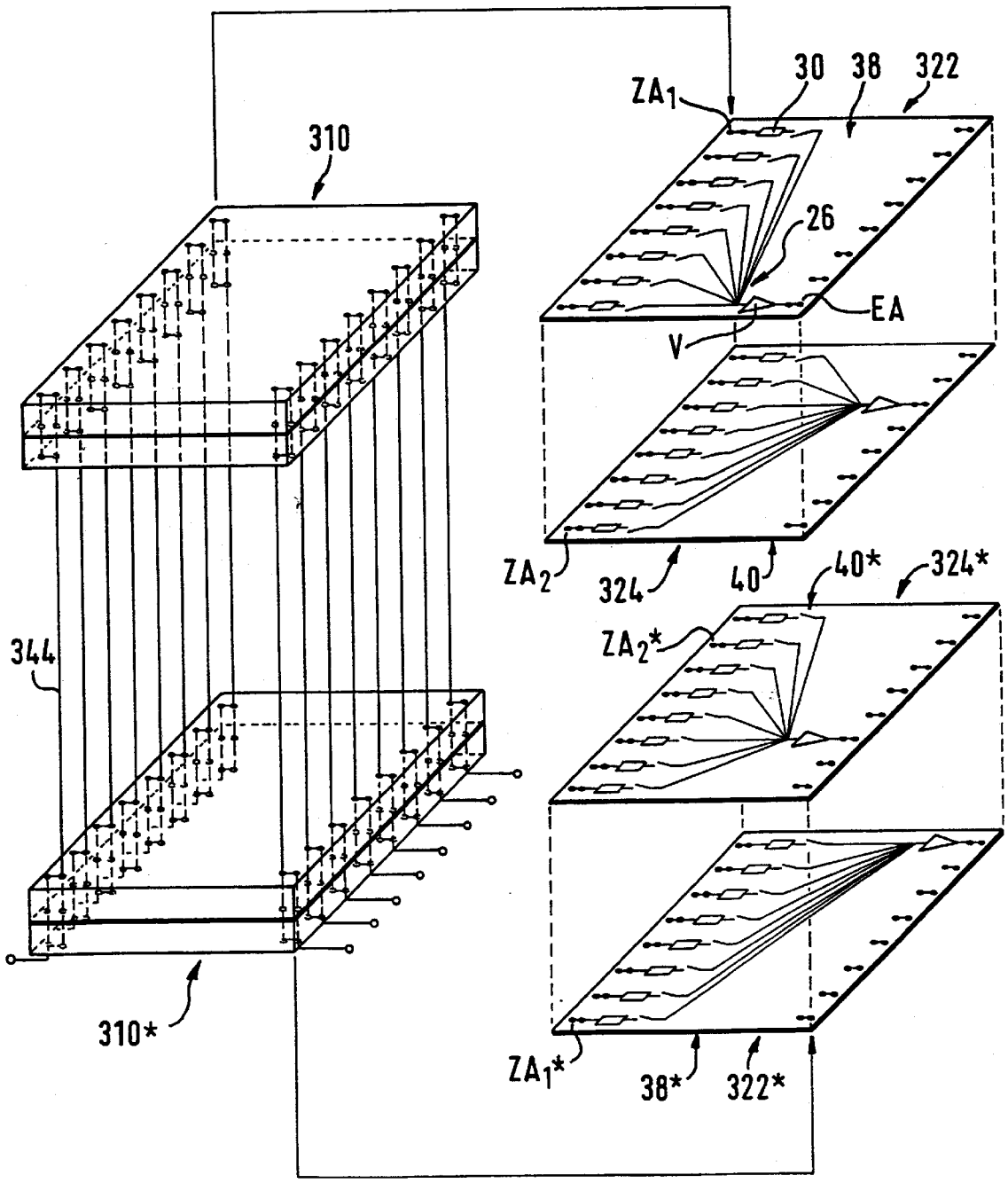
FIG. 5 schematically illustrates a fourth exemplary embodiment of a switching distributor according to the invention similar to FIG. 4 and FIG. 6 schematically illustrates a fifth exemplary embodiment of a switching distributor according to the invention similar to FIG. 4.

In the case of a fourth exemplary embodiment, illustrated in FIG. 5, an eight-in-four switching distributor has been shown, where, similarly to the third exemplary embodiment, distributor circuits 322 and 324, 322* and 324* are arranged in four planes 38, 40, 38* and 40*, where in this case each distributor circuit possesses N=8 second terminals ZA which can be switched by means of the switches 30 and the branching circuit 26 to a first terminal EA, where preferably an amplifier V is also arranged before the first terminal EA.

In other respects the wiring of the four branching circuits 322, 324, 322* and 324* corresponds to that described in the case of the third exemplary embodiment, for which reason reference is made to the description of the third exemplary embodiment in its entirety.

Figure 6:
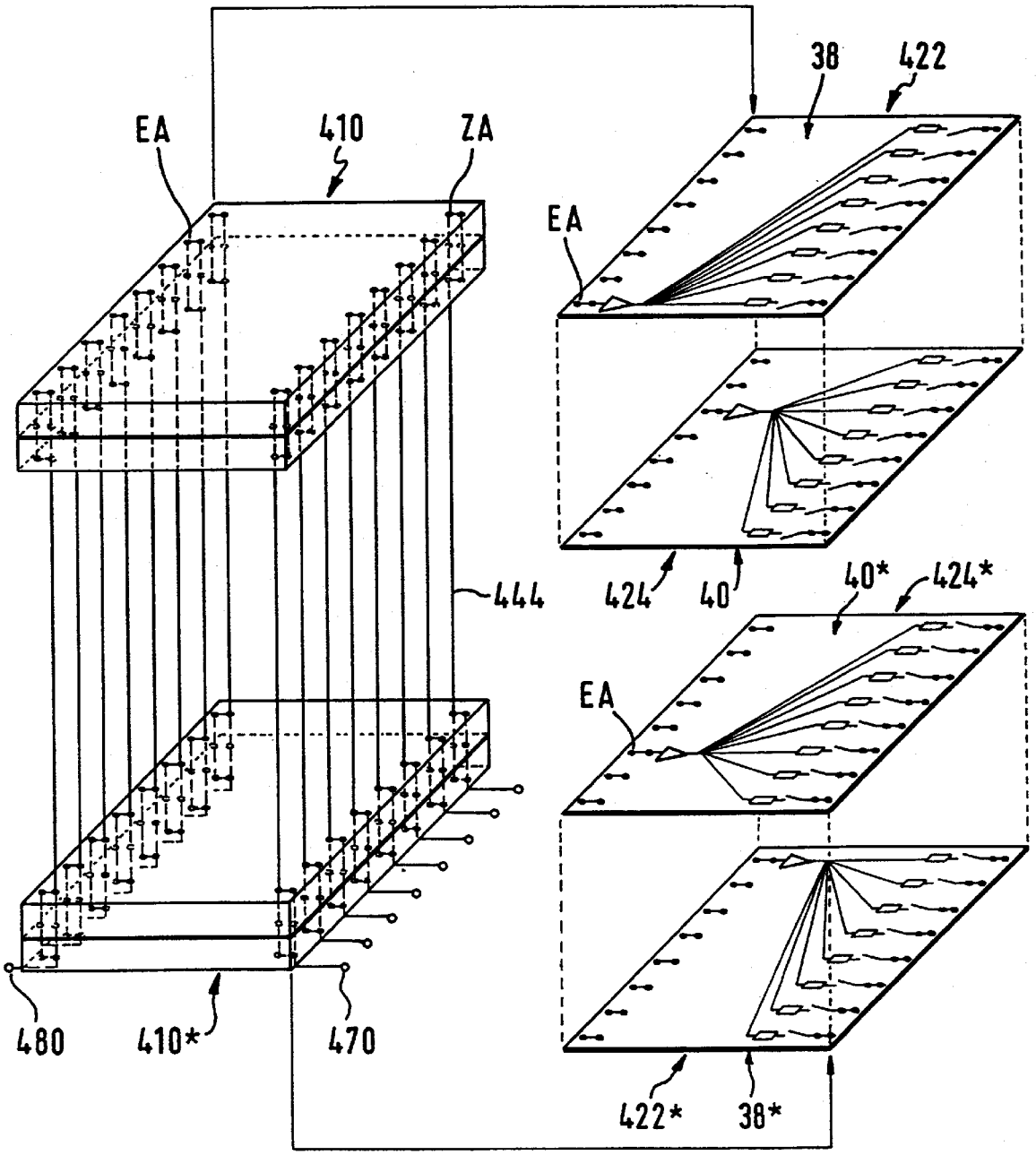

In the case of a fifth exemplary embodiment, illustrated in FIG. 6, a four-in-eight switching distributor has been shown, wherein, again in four planes 38, 40, 38* and 40*, there is in each case arranged a distributor circuit 422, 424, 422* and 424* which corresponds in principle to the distributor circuit 22 or 24 of the first exemplary embodiment, with the difference that N=8 second terminals ZA are provided and thus the branching circuit 26 also possesses N=8 branch lines 28*b* instead of N=4 branch lines 28*b* as in the first exemplary embodiment.

Similarly as in the case of the third or fourth exemplary embodiments, all the second terminals ZA are connected to one another via the plane branching lines 444 which here in turn are connected to the outputs 470, while in each case one of the inputs 480 is connected to one of the first terminals EA of the four distributor circuits 422, 424, 422*, 424*.

In other respects the circuit boards 410 and 410*, similarly to the circuit boards 310 and 310* of the fourth exemplary embodiment, are rotated by 180° relative to one another, so that in both of the exemplary embodiments the same circuit board with the same components can be used twice.

What is claimed is:

1. A high-frequency switching distributor for switching between a plurality of inputs and a plurality of outputs, comprising:

at least two distributor circuits arranged on at least one circuit board, each distributor circuit including, as conductor paths, lines which extend at a defined distance from an electrical ground and which are arranged on a dielectric layer, each of the two distributor circuits being arranged in one of at least two planes extending one above another, each of the distributor circuits having a first terminal, N second terminals, and a branching circuit branching a line into N branch lines, each of said branch lines having an associated switch arranged therein, said line being connected to the first terminal, and each of said N second terminals being switchably connectable to one of the N branch lines via the associated switch, each of the N second terminals of a distributor circuit being connected to one of the N second terminals of the other distributor circuit.

2. A switching distributor according to claim 1, wherein the planes extend in parallel to one another.

3. A switching distributor according to claim 1, wherein the two distributor circuits are arranged on opposite sides of a common ground layer of a three-layer circuit board.

4. A switching distributor according to claim 1, wherein the branching circuit is a resistance branching circuit.

5. A switching distributor according to claim 1, wherein the switches are semiconductor switches.

6. A switching distributor according to claim 1, wherein the electrical ground comprises a layer that has no high frequency (HF) inlets, except in regions of the first terminals and the second terminals.

7. A switching distributor according to claim 1, wherein in each case one of the N second terminals of the one distributor circuit is connected via a plane branching line to in each case one of the N second terminals of the other distributor circuit to form a common terminal.

8. A switching distributor according to claim 7, wherein the plane branching lines extend transversely to the planes.

9. A switching distributor according to claim 7, wherein the plane branching lines extend in parallel to one another.

10. A switching distributor according to claim 7, wherein the plane branching lines extend at right angles to said planes.

11. A switching distributor according to claim 7, wherein the plane branching lines are independent of the circuit board.

12. A switching distributor according to claim 7, wherein the plane branching lines extend in one branching plane.

13. A switching distributor according to claim 12, wherein the plane branching lines extend in the branching plane with no intersections.

14. A switching distributor according to claim 1, wherein the N second terminals of the two distributor circuits are arranged in a second row of terminals of the circuit board.

15. A switching distributor according to claim 1, wherein the first terminals of the two distributor circuits, when projected at right angles to one of the planes, are arranged in a -first row of terminals of the circuit board.

16. A switching distributor according to claim 1, wherein the first terminals of the distributor circuits are arranged in a direction parallel to the planes and spaced at a distance from one another.

17. A switching distributor according to claim 1, wherein at least two circuit boards are arranged one above another in the form of a stack.

18. A switching distributor according to claim 17, wherein the second terminals are arranged in rows disposed one above another in the stack.

19. A switching distributor according to claim 18, wherein the second terminals are connected to one another via plane branching lines extending transversely to the circuit boards.

20. A switching distributor according to claim 19, wherein the second terminals of the circuit boards are connected to one another by means of plane branching lines which are independent of the circuit boards.

21. A switching distributor according to claim 17, wherein the circuit boards are of identical construction.

22. A switching distributor according to claim 21, wherein one of the circuit boards in the stack is arranged rotated by 180° relative to the others.

23. A switching distributor according to claim 1, wherein each of the first terminals is in each case connected to one input and each of the N second terminals of each distributor circuit is in each case connected to one output.

24. A switching distributor according to claim 1, wherein each of the first terminals is in each case connected to one output and each of the second terminals of each distributor circuit is in each case connected to one input.

* * * * *